United States Patent [19]

Jury

[11] 4,071,921

[45] Feb. 7, 1978

[54] DISPOSABLE GREASE ABSORBING MITT

[75] Inventor: Daniel E. Jury, Ulysses, Kans.

[73] Assignee: The Raymond Lee Organization, Inc., New York, N.Y. ; a part interest

[21] Appl. No.: 766,868

[22] Filed: Feb. 9, 1977

[51] Int. Cl.[2] ..... A41D 19/01; A47L 13/18

[52] U.S. Cl. ..... 15/227; 2/158; 206/278

[58] Field of Search ..... 15/104.94, 227; 2/158, 2/161 R; 401/7; 206/278

[56] References Cited

U.S. PATENT DOCUMENTS

| | | | |
|---|---|---|---|
| 1,502,798 | 7/1924 | Phoenix et al. | 15/227 |
| 2,261,064 | 10/1941 | Katz | 15/227 UX |
| 3,369,545 | 2/1968 | Wanberg | 2/158 UX |

FOREIGN PATENT DOCUMENTS

| | | | |
|---|---|---|---|
| 17,678 of | 1913 | United Kingdom | 15/227 |
| 305,511 | 2/1929 | United Kingdom | 15/227 |
| 1,260,031 | 1/1972 | United Kingdom | 15/227 |

*Primary Examiner*—Daniel Blum
*Attorney, Agent, or Firm*—Daniel Jay Tick

[57] ABSTRACT

A disposable grease absorbing device has a pad of grease absorbent material. A sheet of liquid-impervious material is affixed to the grease absorbent material and covers one of the surfaces thereof. A sheet of wrapping material larger than approximately half the area of a surface of the pad is affixed next-adjacent the liquid-impervious material to form a main pocket and is folded over on itself to form an inner pocket. After use, when the grease absorbent material is saturated with grease, it is foldable in a manner whereby the wrapping material restrains it in folded condition with the liquid-impervious material on the outside, so that the grease does not contact or stain anything other than the pad.

2 Claims, 7 Drawing Figures

DISPOSABLE GREASE ABSORBING MITT

BACKGROUND OF THE INVENTION

The present invention relates to a disposable grease absorbing device.

Objects of the invention are to provide a disposable grease absorbing device of simple structure, which is inexpensive in manufacture, used with facility and convenience, and functions efficiently, effectively and reliably to absorb grease in a cleaning task and to restrain the grease saturated pad thereof in a manner whereby the grease does not contact any outside item, so that the device is disposable in a clean, neat, tidy and sanitary manner.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
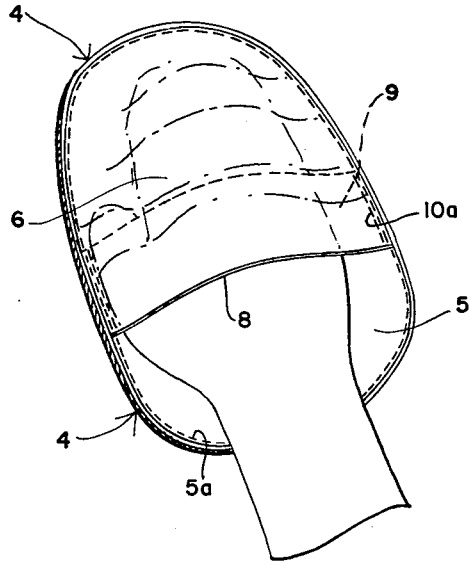
FIG. 1 is a view of an embodiment of the disposable grease absorbing device of the invention in use position.
Figure 2:
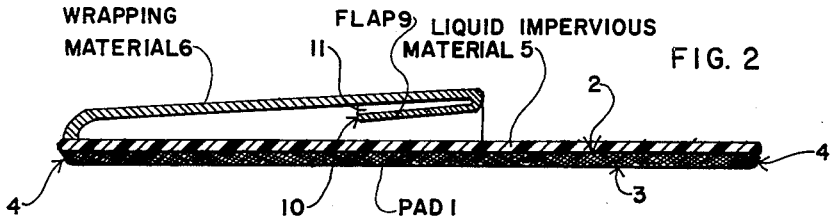
FIG. 2 is a sectional view, on an enlarged scale, of the embodiment of FIG. 1 in use position.

The disposable grease absorbing device of the invention comprises a pad 1 of grease absorbing material of any suitable type, having a pair of spaced opposite surfaces 2 and 3 (FIG. 2) and a bordering edge 4 therearound (FIGS. 1 and 2).

A sheet of liquid-impervious material 5 of any suitable type such as, for example, plastic, is affixed to the grease absorbent material 1 and covers the surface 2 of said grease absorbent material. The sheet 5 and the pad 1 are preferably affixed to each other by a seam 5*a* (FIG. 1) sewn very close to the bordering edge 4.

Figure 3:
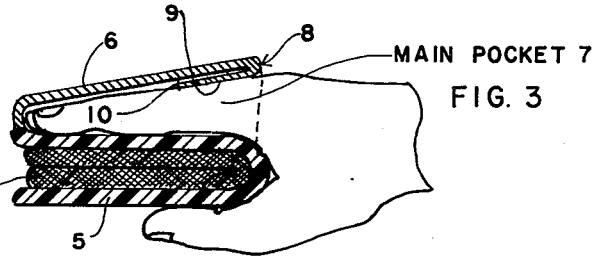
FIG. 3 is a sectional view, on an enlarged scale, of the embodiment of FIG. 2 upon its first folding after use.
Figure 4:
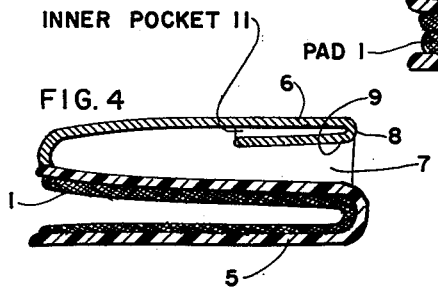
FIG. 4 is a sectional view of the embodiment of FIG. 2 after its first folding, after use.

A sheet of wrapping material 6 of any suitable type such as, for example, cotton cloth, is provided in a size larger than approximately half the area of the surface 2 of the pad 1, as shown in FIGS. 1 and 2. The sheet of wrapping material 6 is affixed to approximately half the bordering edge 4 and next-adjacent the liquid-impervious material 5 to form a main pocket 7 (FIGS. 2, 3 and 4). The sheet of wrapping material 6 is preferably sewn along the same seam joining the liquid-impervious material 5 and the pad 1.

The sheet of wrapping material 6 is folded over on itself along a line 8 to form a flap 9, as shown in FIGS. 2 to 4. The flap 9 has a free line 10 (FIGS. 2 and 3) and a strip extending across the liquid-impervious material along the free line of the wrapping material 6 between said liquid-impervious material and said wrapping material. The flap 9 is affixed to the liquid-impervious material 5 along the bordering edge 4 of said liquid-impervious material by stitching 10*a*, for example (FIG. 1), thereby forming an inner pocket 11 opening into the main pocket 7 formed by the wrapping material 6 and said liquid-impervious material, as shown in FIGS. 2 to 5.

Figure 5:
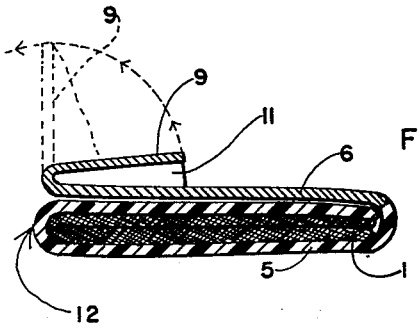
FIG. 5 is a sectional view of the embodiment of FIG. 2 upon its second folding, after use.

In use, when placed in grease, such as, for example, in a frying pan, skillet or any other grease laden area, the grease absorbent material 1 of the device absorbs the grease. The device is then disposable with complete constraint of the grease by folding the pad 1 in half over on itself with half the grease absorbing material 1 abutting the other half thereof, as shown in FIGS. 3 and 4. The main pocket 7 is then twisted in a second folding or step, so that it covers the half of te liquid-impervious material 5 previously uncovered thereby, as shown in FIG. 5, and the inner pocket 11 is outside the wrapping material 6 and spaced from the liquid-impervious material by said wrapping material at the foldover line 12 (FIG. 5) of said liquid-impervious material.

Figure 6:
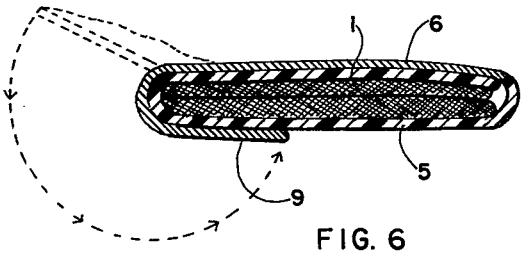
FIG. 6 is a sectional view of the embodiment of FIG. 2 upon its third folding, after use.

In a third step for folding, illustrated in FIG. 6, the inner pocket 11 is twisted so that it covers a strip of liquid-impervious material 5 along the foldover line 12 and restrains the device in folded condition.

Figure 7:
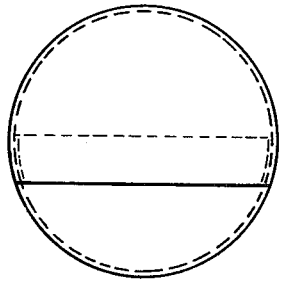
FIG. 7 is a top plan view of a modification of the embodiment of FIG. 1.

Each of the grease absorbent material 1 and the liquid-impervious material 5 is preferably of disc-like configuration and the wrapping material 6 is preferably of semi-disc-like configuration, as shown in FIG. 7, although, obviously, any suitable configuration may be utilized without affecting the operation or efficiency of the device of the invention.

While the invention has been described by means of a specific example and in a specific embodiment, I do not wish to be limited thereto, for obvious modifications will occur to those skilled in the art without departing from the spirit and scope of the invention.

I claim:

1. A disposable grease absorbing device, comprising a pad of grease absorbent material having a pair of spaced opposite surfaces and a bordering edge therearound;

a sheet of liquid-impervious material affixed to the grease absorbent material and covering one of the surfaces thereof;

a sheet of wrapping material larger than approximately half the area of a surface of the pad affixed to approximately half the bordering edge and next-adjacent the liquid-impervious material to form a main pocket leaving an unattached rear portion, said unattached portion being folded over on itself to form a flap having a free line and a strip extending across the liquid-impervious material along the free line of the wrapping material between said liquid-impervious material and the attached portion, said flap being affixed at its ends to the liquid-impervious material along the bordering edge of said liquid-impervious material thereby forming an inner pocket opening into the main pocket formed by the wrapping material and the liquid-impervious material, whereby when placed in grease the grease absorbent material of the device absorbs the grease and the device is then disposable with complete constraint of the grease by folding the pad in half over on itself with half the grease absorbent material abutting the other half thereof, then twisting the main pocket so that it covers the half of the liquid-impervious material previously uncovered thereby and the inner pocket is on the outside and spaced from the liquid-impervious material by said wrapping material at the foldover line of the liquid-impervious material, and then twisting the inner pocket so that it covers a strip of liquid-impervious material along said foldover line and restrains the device in folded condition.

2. A disposable grease absorbing device as claimed in claim 1, wherein each of the grease-absorbent material and the liquid-impervious material is of disc-like configuration and the wrapping material is of semi-disc-like configuration.

* * * * *